US006352170B1

(12) United States Patent
Brown et al.

(10) Patent No.: US 6,352,170 B1
(45) Date of Patent: Mar. 5, 2002

(54) STORAGE ASSEMBLY INCLUDING A LID WITH AN EGRESS BARRIER

(75) Inventors: Dean R. Brown, La Habra; James R. Longstreth, Whittier; Paul M. Winkler, Palos Verdes Est., all of CA (US)

(73) Assignee: Paul Winkler Plastics Corp., Buena Park, CA (US)

( * ) Notice: Subject to any disclaimer, the term of this patent is extended or adjusted under 35 U.S.C. 154(b) by 0 days.

(21) Appl. No.: 09/420,096

(22) Filed: Oct. 18, 1999

(51) Int. Cl.[7] ..... B65D 41/16; B65D 45/00

(52) U.S. Cl. ..... 220/782; 220/792; 220/315

(58) Field of Search ..... 220/4.21, 4.22, 220/4.23, 4.24, 780, 781, 782, 315, 322, 359.1, 377, 792; 206/459.5, 807, 548, 231; 229/125.37; 40/306, 307, 312, 313; 426/383, 87, 396

(56) References Cited

U.S. PATENT DOCUMENTS

| | | | | | |
|---|---|---|---|---|---|
| 1,743,980 | A | * | 6/1930 | Samson | 206/459.5 |
| 2,984,382 | A | * | 5/1961 | Florsheim, Jr. | 220/793 |
| 3,556,338 | A | | 1/1971 | Wilkinson et al. | |
| 3,592,349 | A | | 7/1971 | Baugh | |
| 3,682,365 | A | | 8/1972 | Reifers et al. | 229/2.5 |
| 3,718,274 | A | | 2/1973 | Reifers et al. | 229/2.5 |
| 4,202,464 | A | * | 5/1980 | Mohs et al. | 206/459.5 X |
| 4,256,240 | A | | 3/1981 | Woinarski | |
| 4,290,248 | A | | 9/1981 | Kemerer et al. | 52/309.16 |
| 4,334,631 | A | | 6/1982 | Ballester | |
| 4,373,636 | A | | 2/1983 | Hoffman | 206/551 |
| 4,408,698 | A | | 10/1983 | Ballester | |
| 4,444,332 | A | | 4/1984 | Widén et al. | |
| 4,570,818 | A | * | 2/1986 | Borst et al. | 206/459.5 X |
| 4,574,974 | A | | 3/1986 | von Holdt | |
| 4,706,839 | A | * | 11/1987 | Spence | 220/315 |
| 4,719,087 | A | | 1/1988 | Hanaway | 422/102 |
| 4,834,237 | A | * | 5/1989 | Henke et al. | 206/459.5 X |
| 4,886,184 | A | | 12/1989 | Chamourian | |
| 4,933,216 | A | | 6/1990 | Filbert et al. | 428/34.1 |
| 5,273,174 | A | | 12/1993 | Fisher | 220/4.21 |
| 5,368,178 | A | | 11/1994 | Towns et al. | |
| 5,405,009 | A | * | 4/1995 | Hackenbracht | 220/4.22 X |
| 5,507,429 | A | * | 4/1996 | Arlin | 206/807 X |
| 5,540,342 | A | | 7/1996 | Rathbun | |
| 5,762,221 | A | | 6/1998 | Tobias et al. | 215/381 |
| 5,772,070 | A | * | 6/1998 | Hayes et al. | 220/793 |
| 5,829,595 | A | | 11/1998 | Brown et al. | 206/600 |
| 5,866,181 | A | * | 2/1999 | Hill | 426/383 X |
| 5,866,183 | A | * | 2/1999 | Small | 426/383 |
| 5,897,015 | A | | 4/1999 | Sheahan | |

FOREIGN PATENT DOCUMENTS

| | | | | |
|---|---|---|---|---|
| EP | 420429 | * | 4/1991 | 220/4.23 |

* cited by examiner

*Primary Examiner*—Nathan J. Newhouse
(74) *Attorney, Agent, or Firm*—Kagan Binder, PLLC

(57) ABSTRACT

Lid and container assembly in which lid features and securement strips cooperatively provide the assembly with tamper resistant and tamper indicator features. Specifically, the lid is structured so that one or more simple securement strips, such as adhesive tapes, or even a non-peripherally wrapped shrink band (e.g., one that is wrapped around the assembly from top to bottom), can be used to secure the lid to the container at one or more locations. The securement strip(s) inhibit egress into the container at the taped or secured regions. In the meantime, an egress barrier incorporated into the lid also inhibits egress into the container through untaped or unsecured regions of the assembly. Thus, the assembly is tamper resistant around the entire juncture between the lid and container even though only part of the juncture is covered by the securement strip(s). The combination of the securement strip(s) and egress barrier eliminates the need to use any kind of peripherally-wrapped shrink band to secure the lid to the container.

10 Claims, 7 Drawing Sheets

STORAGE ASSEMBLY INCLUDING A LID WITH AN EGRESS BARRIER

FIELD OF THE INVENTION

The present invention relates to a storage assembly formed by components including a container and a closure such as a lid. More particularly, the present invention relates to such an assembly that incorporates features, preferably securement strips and an egress shield, that cooperate to provide the assembly with tamper resistant and tamper indicator characteristics.

BACKGROUND OF THE INVENTION

A typical lid and container assembly includes a removable lid, mounted onto a container with a snap fit engagement. The lid and container may be separate pieces or formed from a single piece as is the case with a clam-shell (also referred to as a "hinge-lid") container. Such containers are widely known. These lid and container assemblies can be of a wide variety of shapes and sizes and may be used to store a wide variety of items. Due to their relatively low cost, lid and container assemblies made from polymeric materials such as polyester or polyethylene are particularly useful as packaging for foodstuffs. Various types of such assemblies have been described previously, e.g., in U.S. Pat. Nos. 4,256,240; 4,186,184; 5,540,342; 4,444,332; 4,408,698; 3,556,338; 5,368,178; 4,574,974; 4,334,631; and 3,592,349.

Generally, a container and lid assembly must not only protect its contents from the environment, but must also desirably incorporate features that resist tampering and/or that make it easy to determine if someone or something has tampered with, or may otherwise have harmed the integrity of, the contents of the assembly. A number of anti-tamper features have been proposed for use in lid and container assemblies. For example, some lid and container assemblies use foils underneath the lid. Such foils are adhered to the rim of the container to seal its opening. Although it is easy to see when such a foil has been pierced, the lid typically must be removed in order to observe this. Moreover, removing the lid, in and of itself, is an act that can adversely impact the integrity of the contents stored in the lid and container assembly. Sophisticated machinery is also required to apply the foil.

According to another approach, a peripheral band of a shrink wrap material has been used around the entire juncture between the lid and the container in an effort to provide a tamper resistant seal. Tampering is evident if the shrink wrap band has been damaged or removed. Although shrink bands may be effective as tamper indicators, their use involves extra manufacturing steps and expense. For instance, a shrink band itself is relatively expensive. The use of a shrink band as a packaging element also requires the use of ovens to cause shrinking of the band, thus establishing an on-going utility demand for the energy needed to run the ovens. Shrink band material itself generally cannot be used very effectively as a label. Thus, even when a shrink band wrap is used to seal a lid to a container, it often may still be necessary to attach separate label(s) to the assembly for purposes of displaying a logo, graphics, bar codes, product information, instructions, or the like.

U.S. Pat. No. 5,540,342 describes a tamper resistant lid in which the lid incorporates two locking mechanisms. One locking mechanism is in the form of a tear strip that is physically tom away from the lid in order to allow the lid to be removed from the container. The tear strip is discarded after this. The other locking mechanism is used to provide a reusable, snap fit engagement between the lid and container. Use of a tear strip, however, involves extra complexity and more cost for the manufacturer, and hence for the end-user as well.

Accordingly, there remains a need for economical and effective tamper indicators and tamper resistant features for use in lid and container assemblies.

SUMMARY OF THE INVENTION

The present invention provides a storage assembly in which lid features and one or more securement strip(s) that help secure the lid to its container cooperatively provide the assembly with tamper resistant and tamper indicator features. Specifically, the lid is structured so that one or more simple securement strips, such as adhesive tapes, or even a non-peripherally wrapped shrink band (e.g., one that is wrapped around the assembly from top to bottom), can be used to secure the lid to the container at one or more locations. The securement strip(s) inhibit egress into the container at the taped or secured regions. In the meantime, an egress barrier incorporated into the lid also inhibits egress into the container through untaped or unsecured regions of the assembly. Thus, the assembly is tamper resistant around the entire juncture between the lid and container even though only part of the juncture is covered by the securement strip(s). The combination of the securement strip(s) and egress barrier eliminates the need to use any kind of peripherally-wrapped shrink band to secure the lid to the container.

Additionally, any damage or removal of the securement strip(s) is easily observed, so that the strip(s) also function as a tamper indicator. As an additional advantage, information in the form of a logo, graphic images, product information, instructions, bar codes, and/or any other printed information is easily printed onto securement strip(s) in the form of tapes so that the tapes further function as labeling for the assembly. Separate labels need not be affixed to the container. Shrink bands generally cannot serve such a dual purpose.

In one aspect, the present invention relates to a storage assembly including a container and a closure. The container has an opening rim, and the closure releasably engages the opening rim, said engagement forming a peripheral, closure/container juncture. At least one securement strip, which preferably is a strip of adhesive tape for example, secures the closure to the container along one or more portions of the juncture. The strip extends across a portion of the juncture from a surface of the closure to a surface of the container, thus defining at least one covered juncture portion and at least one uncovered juncture portion. One or more egress barriers project downward from the closure into the container. The one or more egress barriers are circumferentially positioned on the closure adjacent to the closure's outer periphery. Said egress barriers are proximal to at least a portion of an uncovered juncture portion to inhibit egress into the container through such juncture portion.

BRIEF DESCRIPTION OF THE DRAWINGS

The above mentioned and other advantages of the present invention, and the manner of attaining them, will become more apparent and the invention itself will be better understood by reference to the following description of the embodiments of the invention taken in conjunction with the accompanying drawings, wherein.

DETAILED DESCRIPTION OF PRESENTLY PREFERRED EMBODIMENTS

Figure 1:
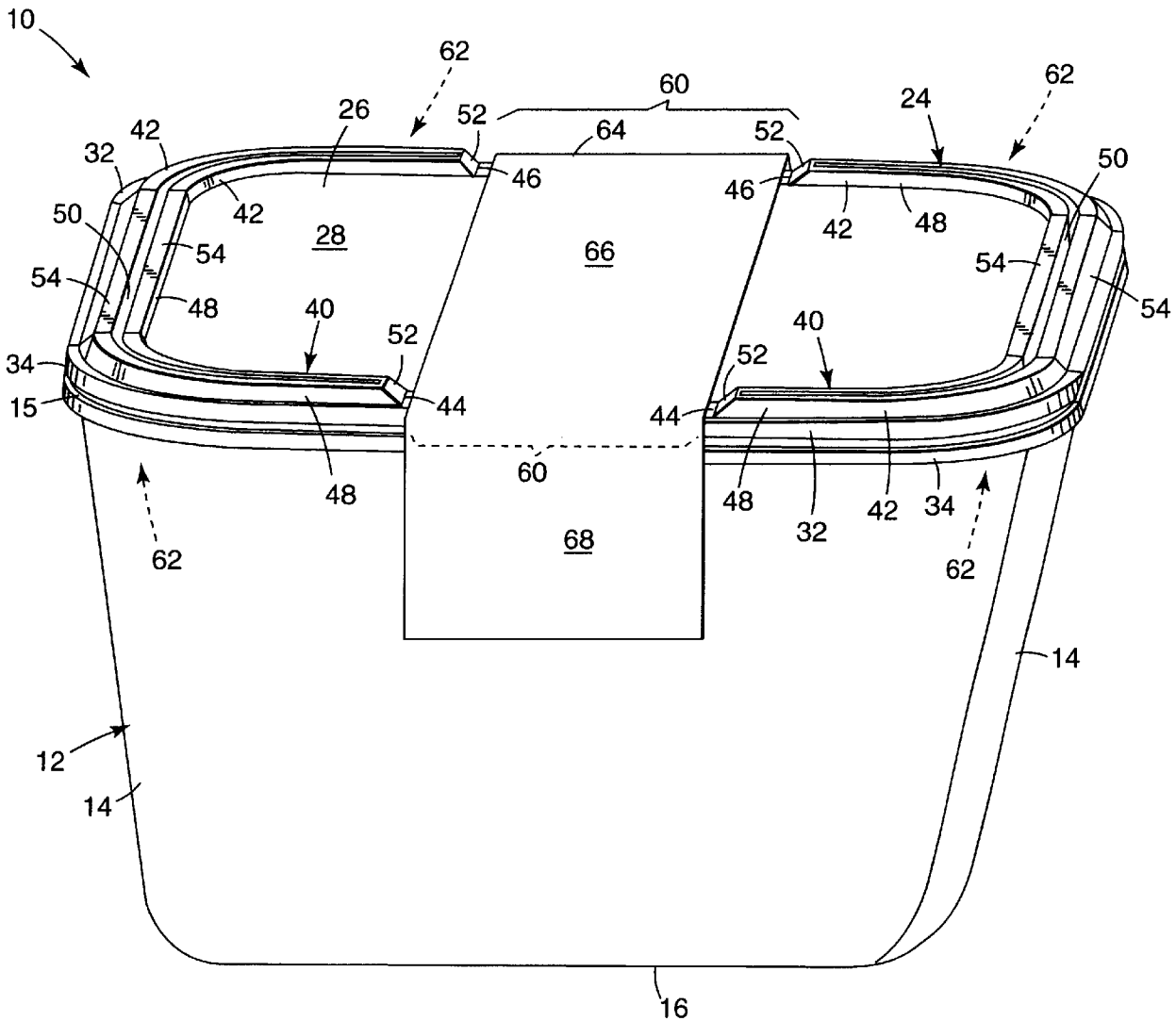
FIG. 1 is a perspective view of one preferred embodiment of a storage assembly of the present invention, wherein the storage assembly includes a lid, a container, and a tape strip securing the lid to the container.
Figure 2:
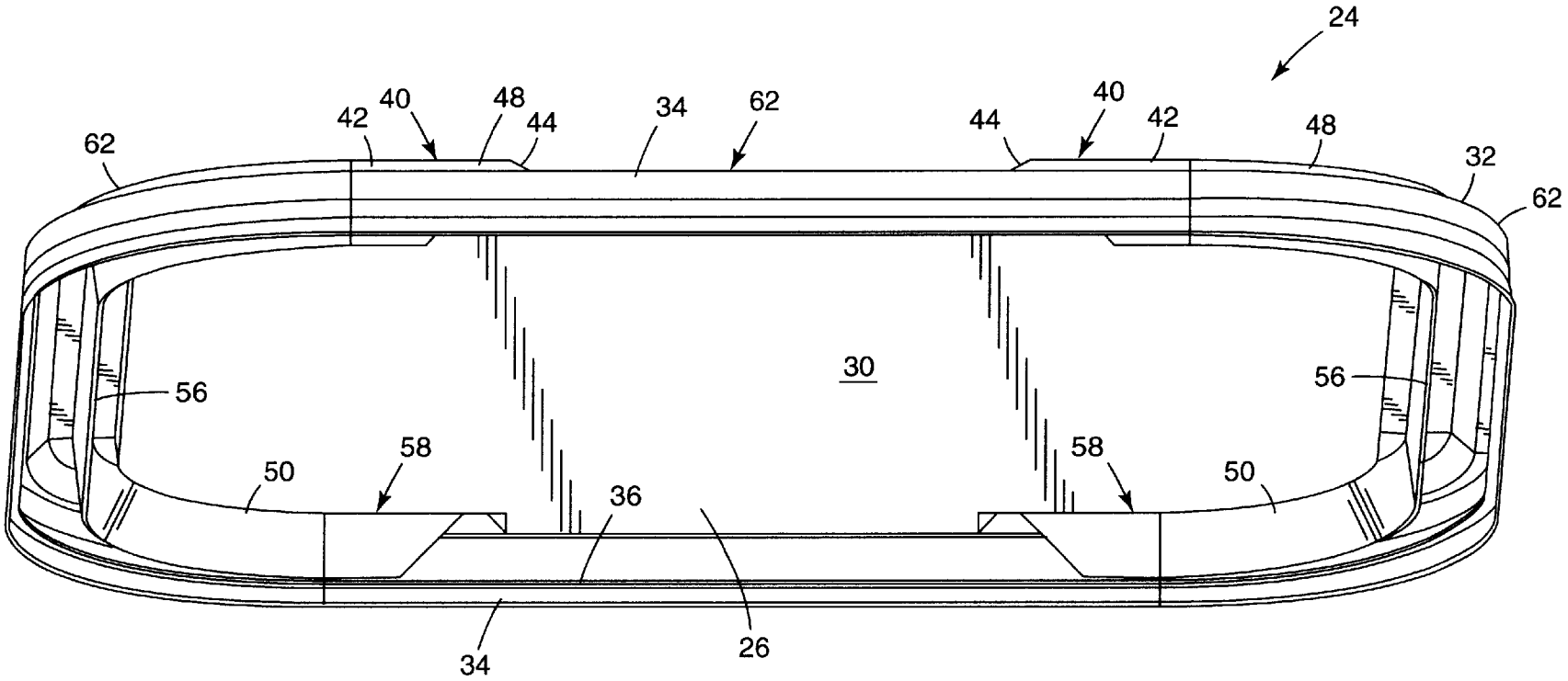
FIG. 2 is a perspective view of the lid of FIG. 1, showing the underside of the lid.
Figure 3:
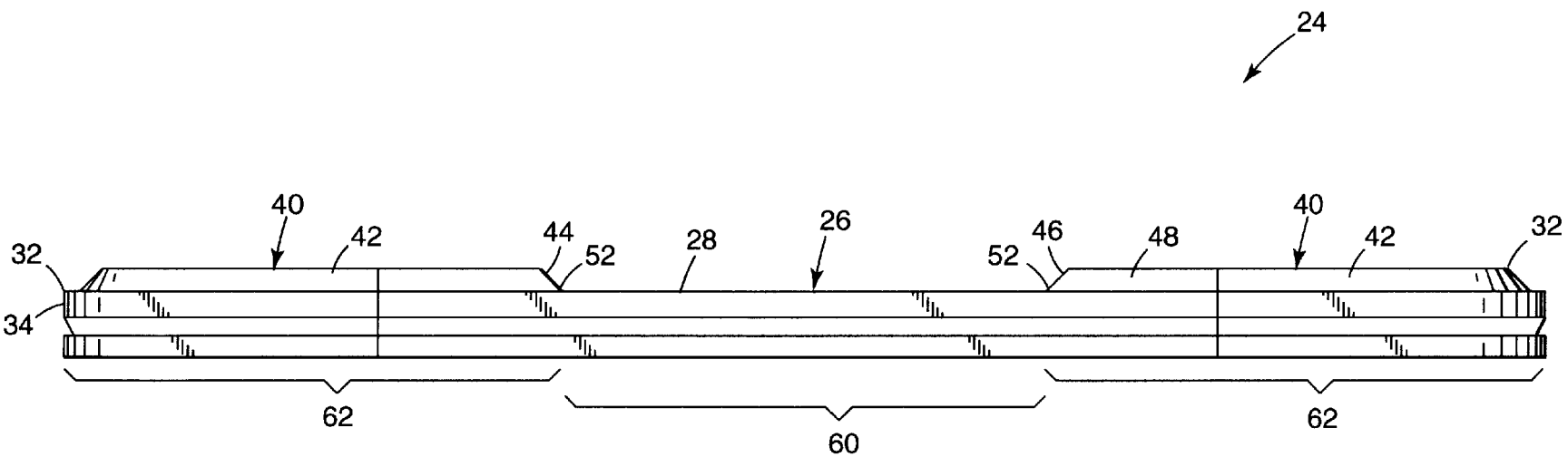
FIG. 3 is a side view of the lid of FIG. 1.
Figure 4:
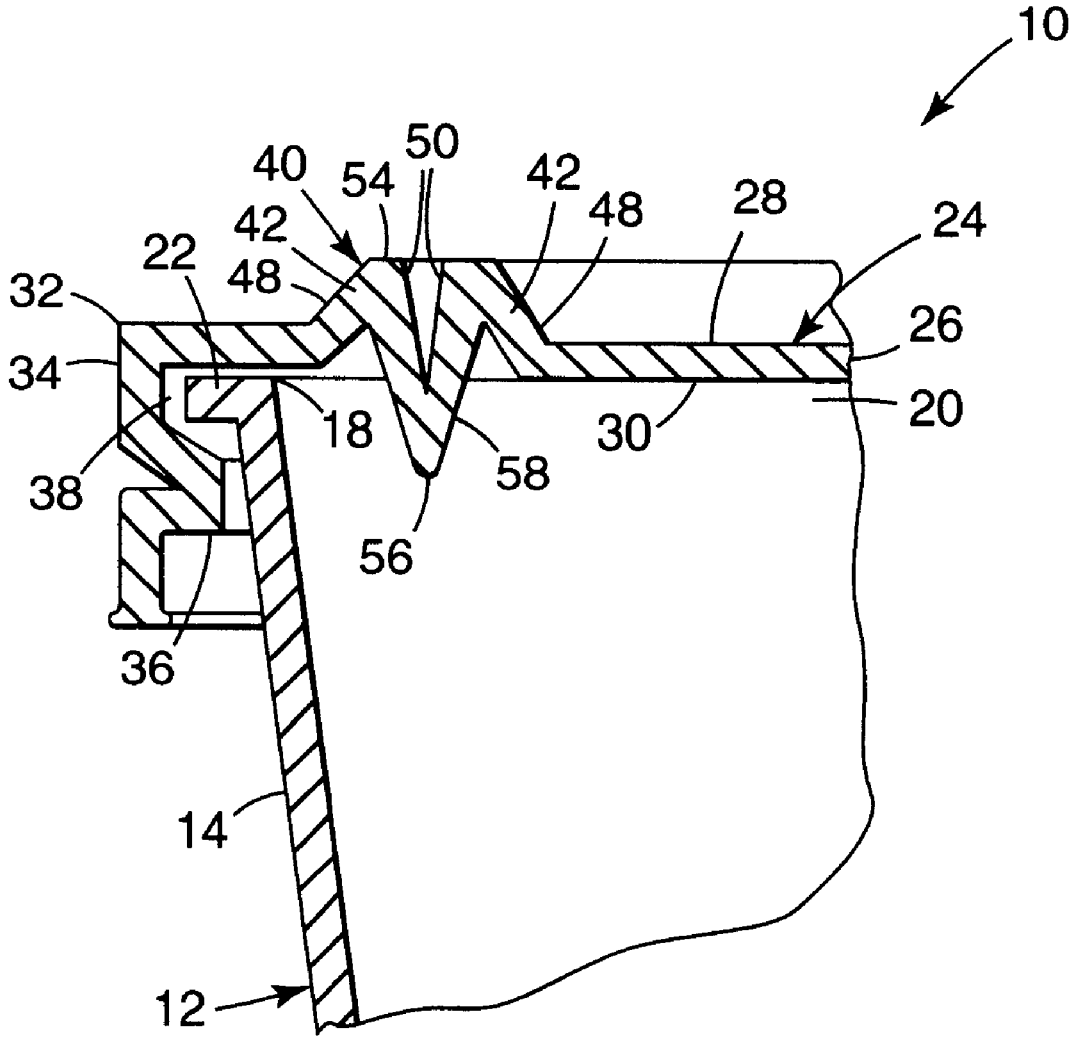
FIG. 4 is a cross-section of a portion of the storage assembly of FIG. 1 showing the engagement between the lid and the container in more detail.
Figure 5:
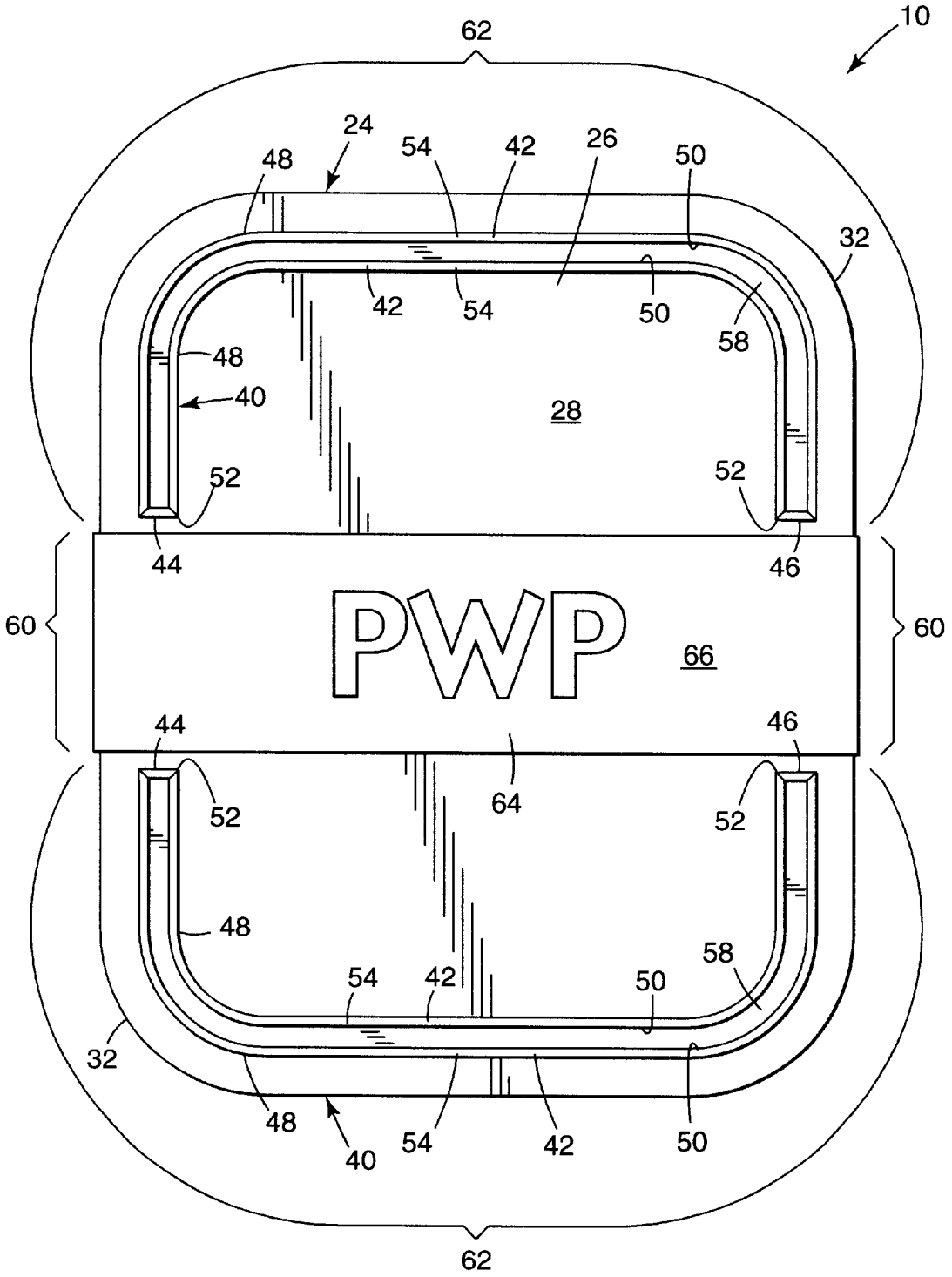
FIG. 5 is a top view of the storage assembly of FIG. 1.

The embodiments of the present invention described below are not intended to be exhaustive or to limit the invention to the precise forms disclosed in the following detailed description. Rather the embodiments are chosen and described so that others skilled in the art may appreciate and understand the principles and practices of the present invention.

FIGS. 1 through 5 illustrate one preferred embodiment of a storage assembly 10 of the present invention. Storage assembly 10 generally includes container 12, a closure in the form of lid 24, and a securement strip 64 in the form of a C-shaped tape strip ("C-clip") that helps to secure lid 24 to container 12. Although shown as separate pieces, container 12 and lid 24 may be formed as a single-piece, clam-shell container if desired. Container 12 and lid 24 may be formed from a wide variety of materials, but each is preferably independently formed from a polymeric material such as polyethylene, polyester, high-impact polystyrene, polyurethane, combinations of these and the like. Storage assembly 10 may be used to store a wide variety of items, but is advantageously used to store food stuff.

Container 12 includes sidewalls 14, bottom 16, and a rim 18 defining container opening 20. Lip 22 extends outward from rim 18 and cooperatively engages with lid 24 in order to secure lid 24 to container 12 with a snap fit engagement. As shown in the Figures, container 12 as shown generally has a rectilinear shape with sidewalls 14 that slightly diverge in a direction upward from bottom 16 to rim 18. However, the shape of container 12 is not critical, and container 12 (and correspondingly lid 24) may have any of a wide variety of shapes and sizes. For example, container 12 may be cylindrical, conical, hourglass shaped, elliptically shaped, squarely shaped, annularly shaped, or the like. For any of these other container shapes, lid 24 would be correspondingly shaped so as to be able to closingly engage container 12.

Lid 24 generally includes cover panel 26 having a first major, external face 28 and a second major, internal face 30. At outer periphery 32 of cover panel 26, skirt 34 extends downward over the portions of sidewalls 14 proximal to rim 18. Skirt 34 incorporates an engagement portion that includes one or more features that allow skirt 34 to engage lip 22 of rim 18 with a snap-fit engagement. Any conventional snap fit structure(s) can be used for this purpose. In the embodiment shown in FIGS. 1 through 5, the engagement portion is formed by inwardly extending rib 36 and internal face 30 of cover panel 26 that cooperatively define pocket 38. When lid 24 is press fit onto rim 18 of container 12, pocket 38 operatively traps lip 22 to accomplish the snap fit engagement.

The engagement between container 12 and lid 24 forms a container/lid juncture 15. Securement strip 64 extends across juncture 15 from a surface of lid 24 to a surface of container 12. This defines covered juncture portions 60 underneath strip 64 and uncovered juncture portions 62 elsewhere around juncture 15. Advantageously, lid 24 includes tamper-resistant features that help inhibit egress into container 12 through uncovered juncture zones 62 (i.e., zones in which strip 64 does not overly the juncture 15 between lid 24 and container 12). Still referring to FIGS. 1 through 5, these egress inhibiting features in the illustrated embodiment generally include pairs 40 of rib-shaped projections 42 that are circumferentially aligned with and adjacent to outer periphery 32 of cover panel 26. Each pair 40 of rib shaped projections 42 is formed by outer walls 48, inner walls 50, end walls 52, and spaced apart top walls 54. Inner walls 50 extend downwardly below second major internal face 39 and into container 12. Each corresponding pair of inner walls 50 converge and interconnect at bottom 56. The portions of inner walls 50 projecting downwardly from second major, internal face 30 of cover panel 26 define egress shield 58 proximal to rim 18 of container 12. When lid 24 is engaged with lip 22 of container 12, egress shield 58 forms a barrier behind juncture 15 between lid 24 and container 12 to inhibit egress into storage assembly 10.

Advantageously, each pair 40 of rib-shaped projections 42 has a V-shaped, corrugated structure that helps stiffen lid 24. Thus, these features preferably act as both a physical barrier and a stiffener. Projections 42 also provide a receptacle on the top of lid 24 to facilitate stacking of assemblies 10 on each other.

Each pair 40 of rib shaped projections 42 extends along only a portion of the peripheral region of cover panel 26 from respective first ends 44 to respective second ends 46. The space between first ends 44 and second ends 46 for this embodiment, provide a convenient a pathway for strip 64 to be led nonperiherally from first major, external face 28 of cover panel 26 to the sidewalls 14. In the particular embodiment shown in FIGS. 1 through 5, there are two covered juncture zones 60 directly opposite each other on first major, external face 28. This configuration allows single strip 64 in the form of a C-clip to be used to attach lid 24 to container 12. Tape ends 68 of tape strip 64 are easily adhered to sidewalls 14, while middle tape portion 66 is easily adhered to cover panel 26. Advantageously, tape strip 64 securely holds lid 24 onto container 12 without requiring the traditional shrink band that otherwise would be peripherally wrapped around the entire juncture between lid 24 and container 12 to secure lid 24 in place on container 12.

Even though strip 64 secures a lid 24 to sidewalls 14 only at the respective covered juncture zones 60, egress shield 58 adequately prevents unwanted egress into container 12 through uncovered juncture zones 62. For example, if a person were to try to stick a finger or other item into storage assembly 10 through an uncovered juncture zone 62, where strip 64 is not used, egress shield 58 prevents the entry both as a physical barrier and as a stiffener. If a person were to wrongfully remove or tear strip 64, to gain access to the assembly contents, the tampering would be easily confirmed. As another advantage, printed information 65 in the form of a logo, illustration, bar code, product information, or other printed or graphical information is easily printed onto tape strip 64. This would eliminate, if desired, the conventional labeling that might otherwise be placed onto lid 24 and/or container 12 in order to convey desired information to a user.

Figure 6:
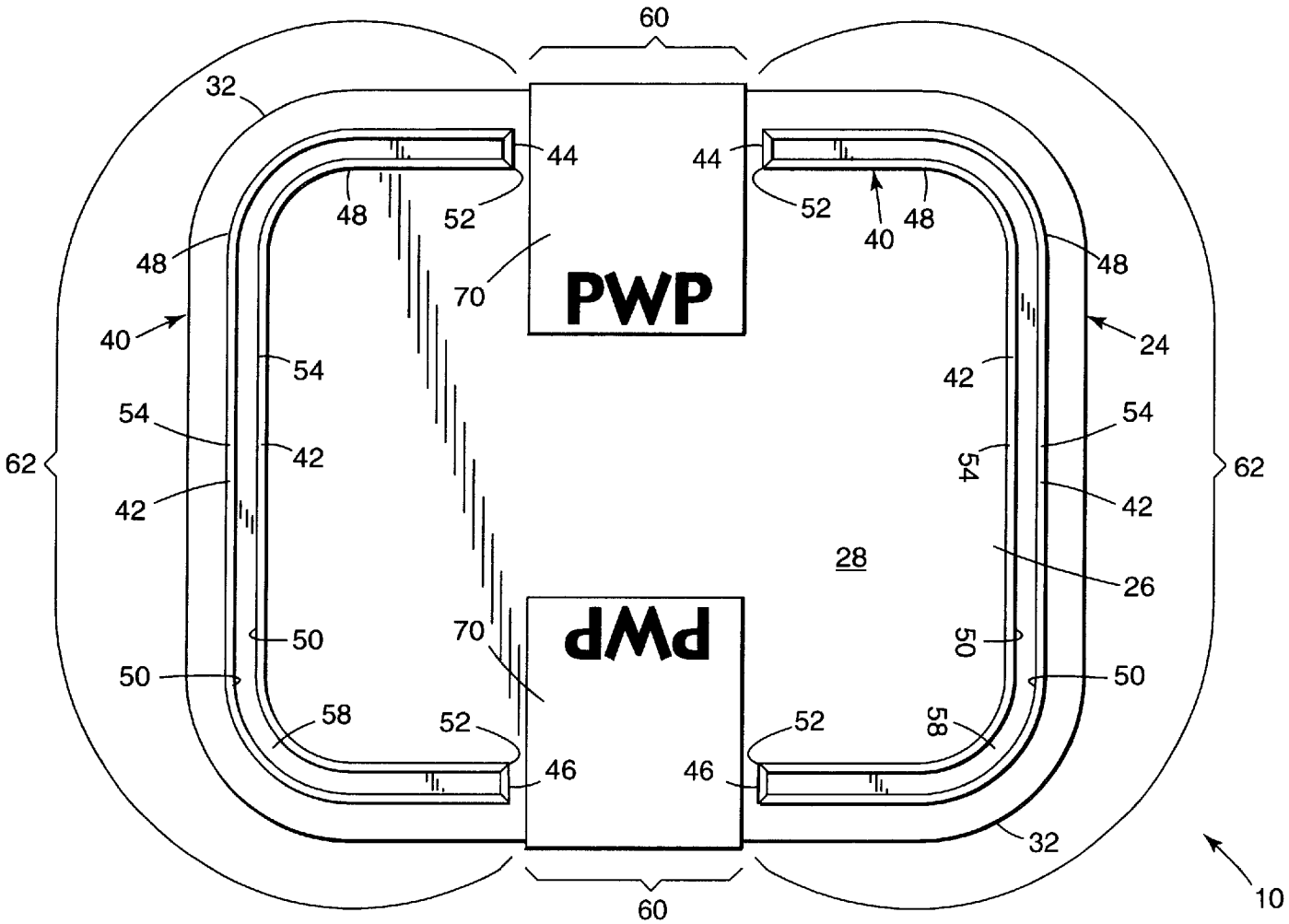
FIG. 6 is a top view of an alternative embodiment of the present invention.

Storage assembly 10 shown in FIGS. 1 through 5 includes two pairs 40 of rib shaped projections 42, two covered engagement zones 60, and a single tape strip 64 in the form of a C-clip. Of course, other configurations of these features may also be used in the practice of the present invention. For example, as shown in FIG. 6, two tape strips 70 in the form of L-clips are used in storage assembly 10 instead of a single tape strip. Each tape strip 70 has a first end 72 adhered to first major, external face 28 of cover panel 26 and a second end 74 adhered to a corresponding sidewall 14.

Figure 7:
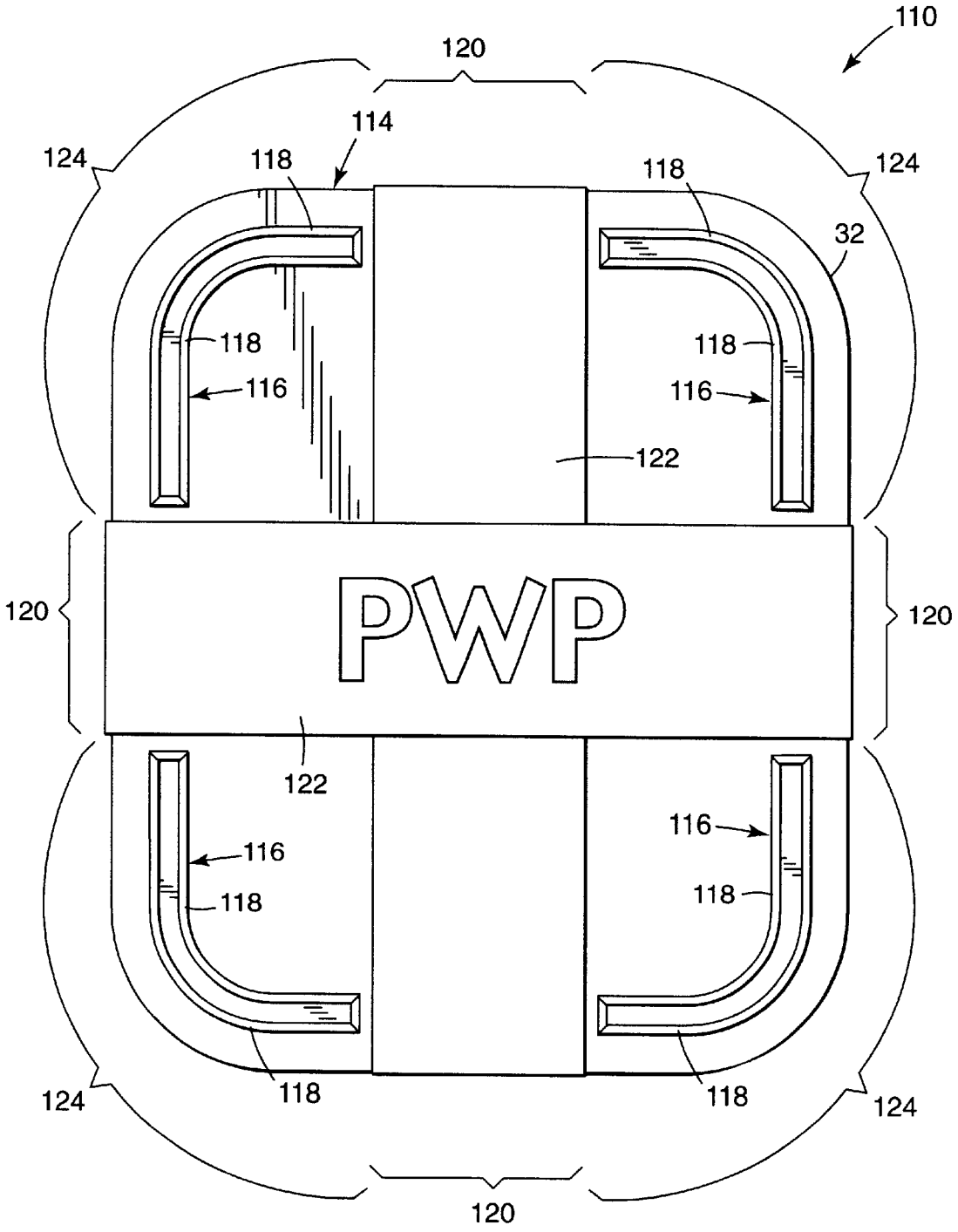
FIG. 7 is a top view of another alternative embodiment of the present invention.

Another embodiment of a storage assembly 110 is shown in FIG. 7. Storage assembly 110 includes container 112 and lid 114 secured to container 112 with a snap fit engagement. Lid 114 includes four pairs 116 of projecting ribs 118 that define for tape attachment zones 120 and four corresponding, downwardly projecting egress shields (not shown). Two criss-crossing, perpendicular individual tape strips 122 in the form of C-clips are used to secure lid 114 to container 112. In the uncovered juncture zones 124 between the covered juncture zones 120, egress shields (not shown) corresponding to the four pairs 116 of projecting ribs 118, respectively, inhibit egress into container 112. As an option, four tape strips (not shown) in the form of L-clips can be used to secure lid 114 to container 112 instead of using the two individual tape strips 122 as shown in FIG. 7.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims.

What is claimed is:

1. A storage assembly, comprising:

a) a container having an open rim;

b) a closure having an outer periphery, wherein the closure releasably engages the open rim, said engagement forming a closure/container juncture;

c) at least one securement strip extending across a portion of the juncture from a surface of the closure to a surface of the container, thereby defining at least one covered juncture zone and at least one uncovered juncture zone;

d) one or more egress barriers that project downward from the closure into the container, wherein the one or more egress barriers are circumferentially positioned on the closure adjacent the closure outer periphery and are proximal to at least a portion of an uncovered juncture zone to inhibit egress into the container through the portion of the uncovered juncture zone, said egress barrier comprising a corrugated structure effective to help stiffen the closure at least in a portion of the closure adjacent an uncovered juncture zone.

2. The storage assembly of claim 1, further comprising a skirt extending from the outer periphery of the closure, said skirt incorporating an engagement portion that will releasably engage a corresponding engagement structure on the container.

3. The storage assembly of claim 1, wherein said corrugated egress barrier comprises an inner wall and an outer wall that extend downwardly into the container and that converge at a bottom of the egress barrier.

4. The storage assembly of claim 1, wherein the one or more securement strips comprise a C-clip.

5. The storage assembly of claim 1, wherein the one or more securement strips comprise an L-clip.

6. The storage assembly of claim 1, wherein the closure and the container are separate pieces.

7. The storage assembly of claim 1, wherein the closure is hingedly connected to the container.

8. The storage assembly of claim 1, wherein the assembly has a clam-shell structure.

9. The storage assembly of claim 1, wherein said corrugated egress barrier is adjacent but spaced from at least one container wall.

10. The storage assembly of claim 1, wherein the assembly comprises a plurality of said corrugated egress barriers, wherein respective portions of the egress barriers extend above the closure as projecting ribs, said ribs having spaced apart ends between which one or more of said securement strips can extend across the closure/container juncture from a surface of the closure to a surface of the container.

* * * * *